United States Patent [19]

Veith

[11] 4,437,044

[45] Mar. 13, 1984

[54] FLAT CATHODE RAY TUBE AND METHOD OF OPERATION

[75] Inventor: Werner Veith, Heidelberg, Fed. Rep. of Germany

[73] Assignee: Siemens Aktiengesellschaft, Berlin & Munich, Fed. Rep. of Germany

[21] Appl. No.: 375,405

[22] Filed: May 6, 1982

Related U.S. Application Data

[63] Continuation-in-part of Ser. No. 109,810, Jan. 7, 1980, abandoned.

[30] Foreign Application Priority Data

Jan. 25, 1979 [DE] Fed. Rep. of Germany ..... 2902852

[51] Int. Cl.[3] ..... H01J 29/70; H01J 29/72

[52] U.S. Cl. ..... 315/366; 313/422

[58] Field of Search ..... 315/366; 313/422

[56] References Cited

U.S. PATENT DOCUMENTS 3,956,667 5/1976 Veith .
4,103,204 7/1978 Credelle .
4,103,205 7/1978 Credelle .
4,158,210 6/1979 Watanabe et al. .

FOREIGN PATENT DOCUMENTS 1277451 4/1969 Fed. Rep. of Germany .
2412869 10/1975 Fed. Rep. of Germany .
2638308 3/1977 Fed. Rep. of Germany .

OTHER PUBLICATIONS

Article J. S. Cook et al., "Slalom Focusing", Proceedings of the IRE, Nov. 1957, pp. 1517–1522.

*Primary Examiner*—Theodore M. Blum
*Attorney, Agent, or Firm*—Hill, Van Santen, Steadman & Simpson

[57] ABSTRACT

A flat cathode ray tube and method of using characterized by an evacuated chamber being subdivided into a guidance space and post deflection space by a control plate having row electrodes or conductors on one side and column electrodes or conductors on the other side which column electrodes face a cathode-luminescent layer in the deflection space and a source for producing a flat electron beam being positioned at the side of the guidance space. In controlling the beam, a beam guidance electrode in the guidance space is utilized so that the beam will move in a sinuous path and strike each of the selected row conductors with the desired angle. To accomplish this feature, the wave length of the path of the flat beam for adjacent rows is changed so that the beam is deflected from the same position in the wave length.

20 Claims, 8 Drawing Figures

Fig. 2

FLAT CATHODE RAY TUBE AND METHOD OF OPERATION

CROSS-REFERENCES TO RELATED APPLICATIONS

This application is a continuation-in-part of application Ser. No. 109,810, filed Jan. 7, 1980, now abandoned, by the same inventor.

BACKGROUND OF THE INVENTION

1. Field of the Invention

The present invention is directed to a flat cathode ray tube which has a container with a cathodo-luminescent layer on one surface and guides a beam of electron along a sinuous path to a point for direction against the luminescent layer.

2. Description of the Prior Art

Among the plurality of previously discussed concepts for a flat display screen, a display which operates on a gas discharge basis appears to have the best prospects for success. If color moving pictures are displayed, this is particularly true. A structure, which is especially promising for a flat display screen utilizes a gas filled envelope which is sub-divided by means of a control structure into a front and back space. The control structure consists of perforated row conductors and perforated column conductors with the row conductors facing a surface cathode which is provided on a back surface of the envelope while the column conductors are turned or directed towards the front surface of the envelope which is provided with luminescent layer and a post deflection acceleration anode. The spacing between the column conductors and the acceleration anode is so small that even with a potential difference of several kV, no gas discharge is brought about. In operation, an approximately wedge-shaped gas discharge burns between the surface cathode and the row which has been selected and the column conductors obtain signal voltages which either block electrons of the gas discharge or draw them through the openings of the control structure into the front space. These electrons are accelerated by the acceleration anode and strike the luminescent screen or layer to generate a luminous spot at the location of impact. A description of the above structure is found in my U.S. Pat. No. 3,956,667 which was based on German O.S. No. 2,412,869. The operation of the structure is explained in greater detail in the disclosure of the U.S. patent which is incorporated herein by reference.

With the display principles which have been described hereinabove, television pictures, which are already colored can be generated with a quite promising optical quality. However, previously built displays do not yet function with sufficient reliability because of the problems, which are connected with the gas filling of the envelope, cathode sputtering, fluctuations in the gas pressure, dangers of arc-through which will occur with the necessary high accleration voltages that are required after the deflection step. These problems with reliability of these screens has not yet been satisfactorily solved.

The above noted difficulties are eliminated when one does not use a gas discharge as an electron source but rather uses a common cathode as in the case for example of a panel type display disclosed in U.S. Pat. No. 4,103,204. In the case of this embodiment, a cathode, which is extended parallel to the direction of a row releases a multiplicity of point-form electron beams which number will correspond to the column count of a picture matrix. In the beam guidance space, the individual beams are kept on sinuous paths with the electrons moving around wires which run parallel to the row and the common cathode. In the framework of this proposal, a row sequential addressing can be accomplished by deflecting the beams row for row and each of the beams can receive information by means of modulation of the electron source.

Such a system offers a number of advantages, a cathode requires a small surface and therefore only a small quantity of heat can be radiated and little cathode material will be vaporized. In addition, there is a very small structural depth for the number of vibrations in the sinuous path which are carried out by electron beams corresponds to the count of the row. In accordance with this, the height of amplitude of the vibration measurement for the beam for the thickness of the beam guidance space has a value similar to that of the row spacing. However, these advantages are opposed by an important disadvantage. The "slalom focusing" which is used and discussed in great detail in the article by J. S. Cook et al, "Slalom Focusing", *Proceedings of the IRE*, November, 1957, pp. 1517–22 requires an especially precise dimensioning which significantly increases the manufacturing cost. This is particularly in the case of a display with a fine raster of picture points and corresponding filigree construction. Due to these costs, it is estimated that the standard size television screen of this structure can only be manufactured with an unacceptable high expenditure in manufacturing costs.

SUMMARY OF THE INVENTION

The present invention is directed to solving the problems for developing a display technique in the case of which a display can be flat, requires no gas filling and therefore is relatively simple to conceive. Also, the invention should permit the display of a relatively dense picture point matrix.

To accomplish these goals, the present invention provides a flat cathode ray tube comprising an evacuated container having a front and back wall extending parallel to each other, said front wall supporting a cathode-luminescent layer and a flatly extending acceleration anode, said back wall having a flatly extending back electrode, said container in a plane extending parallel to the front and back wall being provided with a central plate or substrate having a plurality of parallel extending conductive strips forming row conductors facing the back elelctrode and on a surface opposite the row conductors being provided with a plurality of parallel conductive strips extending perpendicular to the direction of the row conductors to form column conductors, said substrate being positioned to sub-divide the chamber into a back chamber and front chamber and being provided with apertures disposed in the row conductors; an electron source extending along side wall parallel to the row conductors, said electron source including one emission cathode and an attraction anode to produce a flat electron beam having a width which extends the entire length of the row conductor and extends parallel to the row conductors; a beam guidance electrode of equal potential extending in a plane parallel to the back wall in the back chamber between the row conductors and the back electrodes; means for controlling the potentials applied to the back electrode, the front acceleration electrode, the emission cathode, the attraction anode, the beam guidance electrode, and the selected and non-selected row conductors so that a flat beam leaving the electron source travels in a sinuous path penetrating the plane of the beam guidance electrode at least once; said means for controlling changing the applied potential to change the wave length of the path of the electron beam in a saw-tooth-like manner so that the beam strikes a plurality of row conductors of a group of row conductors after the same number of half wave lengths of the path; and means providing selected signal voltages to said column conductors to selectively block the passage of the electron beam through the space points of the selected row conductor and enabling passage at other points so that selected points in the row of the electro-luminous layer associated with the selected row conductor are energized.

The method or process of using the flat cathode ray tube includes providing a cathode ray tube of the above described structure; controlling the potentials applied to the various electrodes such as the back electrode so that the flat beam leaving the electrode source travels in a sinuous or serpentine path penetrating the plane of the beam guidance electrode at least once prior to penetrating the selected row conductor; changing the applied voltage to change the wave length of the path of the electron beam in a saw-tooth-like manner so that the beam strikes a plurality of row conductors of the group after the same number of half wave lengths of the path; and providing the selected signal voltages to the desired column conductors to selectively block the passage of the electron beam through the space points of the selected row conductor and enabling passage at the other points.

The proposed method and ray tube are characterized by the following features. The information from the just scanned row is not communicated to the electron source but is communicated to the electrons only after the beam is attempting to pass through the column conductors. This shift makes it possible to use a single flat beam which, as known, can be manipulated electron optically very easily and besides this requires only one beam generating system.

The electron beam will experience no coaxial slalom focusing. Namely, in the beam guidance space, which is in the back chamber, no wavy equal potential surfaces arise upon which the electrons must move but rather a potential plane is generated which delivers a pure cross field and which is periodically traversed by the electrons of the electron beam as they travel in their wave shape or serpentine path. In the case of such a beam guidance, the focusing does not need to be especially precise and the electron source can release a relatively high current strength. If the potential plane is realized by means of the beam guidance anode, or electrode, which is provided with a high transmission factor embodied in approximately the form of a fine grating, then the electrode will intercept only a relatively few electrons. In addition, the electron source can be compensated easily if it occurs by increasing the cathode current corresponding with the increased length in the electron path.

Another important feature of the present invention is that by use of a saw tooth modulation of the wave length of the path of the electron beams, the flat electron beam will approach each deflection location for passing through a row conductor in the same phase of its wave shaped of serpentine path and thus is always deflected in the same manner. The column conductors, which are located on the optical path of the rays behind the row conductors provided for the fact that the electrons enter into a post deflection acceleration space bundled and extending vertical to the column and row conductors. Thus, very fine luminescent spots occur on the electro-luminescent screen or layer. The fact that the flat beam, which is shot into the back chamber obliquely between two capacitor plates will trace out a parabolic curve in the opposing field and is again sharply defined in the shooting plane, has been known for a long time. For example, it is disclosed in the German Pat. No. 1,277,451 which has a coding tube which is utilized for a pulse modulation but does not serve for an optical display and the patent document does not concern itself with the problems of the matrix addressing system.

DESCRIPTION OF THE PREFERRED EMBODIMENTS

Figure 1:
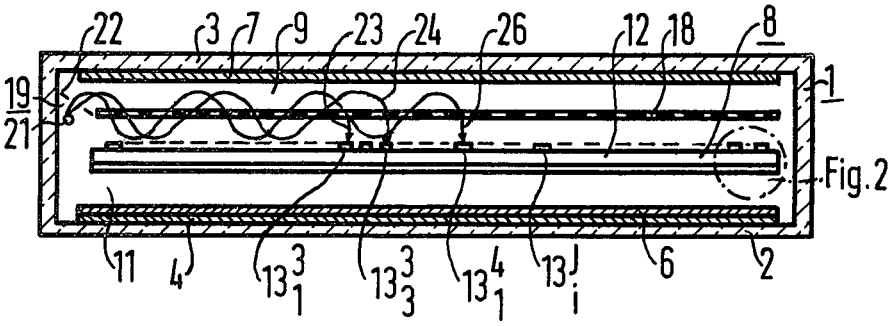
FIG. 1 is a cross-sectional view of a cathode ray tube in accordance with the present invention.

The principles of the present invention are particularly useful in a cathode ray tube generally indicated at 100 in FIG. 1. The cathode ray tube 100 is schematically illustrated in FIG. 1 with many of the details, which are not absolutely necessary for the purposes of understanding the invention, are not illustrated.

As illustrated, the cathode ray tube or display 100 has a chamber of housing 1 with front wall 2 and a back wall 3 which extend parallel to each other. The front wall 2 supports a luminescent layer or screen 4, which can be activated by means of electrons striking thereupon. To cover this layer 4, a post deflection acceleration anode 6 is provided. The back 3 is provided on its interior surface with a flat electrode, such as a counter or back electrode 7 which may be continuous or broken up in parallel extending narrow strips such as 7*a* and 7*b* or a combination of large strips and narrow strips (as illustrated). The interior of the housing or chamber 1 is subdivided into a back or beam guidance chamber 9 and a front or post acceleration chamber 11 by a control plate 8 which extends parallel to the front and back walls 3 and 4 of the chamber 1.

Figure 2:
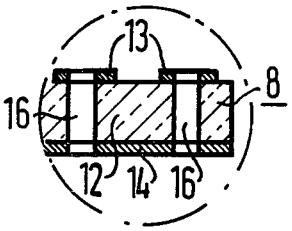
FIG. 2 is an enlarged cross-sectional view taken in the chain circle II in FIG. 1.

As best illustrated in FIG. 2, the control plate 8 comprises a substrate 12 which on a surface facing the back wall 3 is provided with a plurality of strip shaped electrodes or conductors 13 which extend parallel to each other and form row conductors. If the back electrode is formed by parallel strips such as 7*a* and 7*b*, then the row conductors 13 also extend parallel to these strips forming the back electrode. On the other surface, the substrate is provided with a plurality of strip shaped electrodes or conductors 14 which extend parallel to each other and perpendicular to the direction of the row conductors 13 to form column conductors. At each of the points of intersection between the row conductors 13 and the column conductors 14, the substrate 12 is provided with a control plate aperture 16. Control plates having such a matrix design are known and disclosed in greater detail in the U.S. Pat. No. 3,956,667 which was discussed hereinabove.

In the beam guidance space or back chamber 9, a beam guidance electrode or anode 18, which is formed by a sheet perforated to form a grid is provided. As illustrated, the beam guidance anode 18 extends parallel to the front and back walls 2 and 3 as well as to the control plate 8. At the edge of the chamber 1 on one of the sides which extend parallel to the row conductors 13, means 19 for generating or providing an electron beam is provided. This system or means consists of strip shaped emission electrode 21 which runs parallel to the row conductors 13 and a first or an attraction anode 22. The attraction anode 22 in the present case is electrically interconnected with the grid forming the beam guidance anode or electrode 18. The means generating an electron beam is designed so that it produces a flat beam of electrons which extend from the means or source 19 into the beam guidance or back chamber 9 at angle of 45° to the counter or back electrode 7. Means 101 for controlling the potential which is applied to the back electrode 7, the front acceleration electrode or anode 6, the emission cathode 21, the attraction anode 22, the beam guidance electrode 18, and the selected and non-selected row conductors 13 is schematiclly illustrated. The signal voltage may be television picture signals so that the tube 100 diaplays a television picture. Each of the means 101 and 102 are of conventional and known construction. In addition, means 102 for providing a selected signal voltage to the selected column conductor 14 is also provided and as illustrated is interconnected for purposes of control with the means 101.

Figure 6:
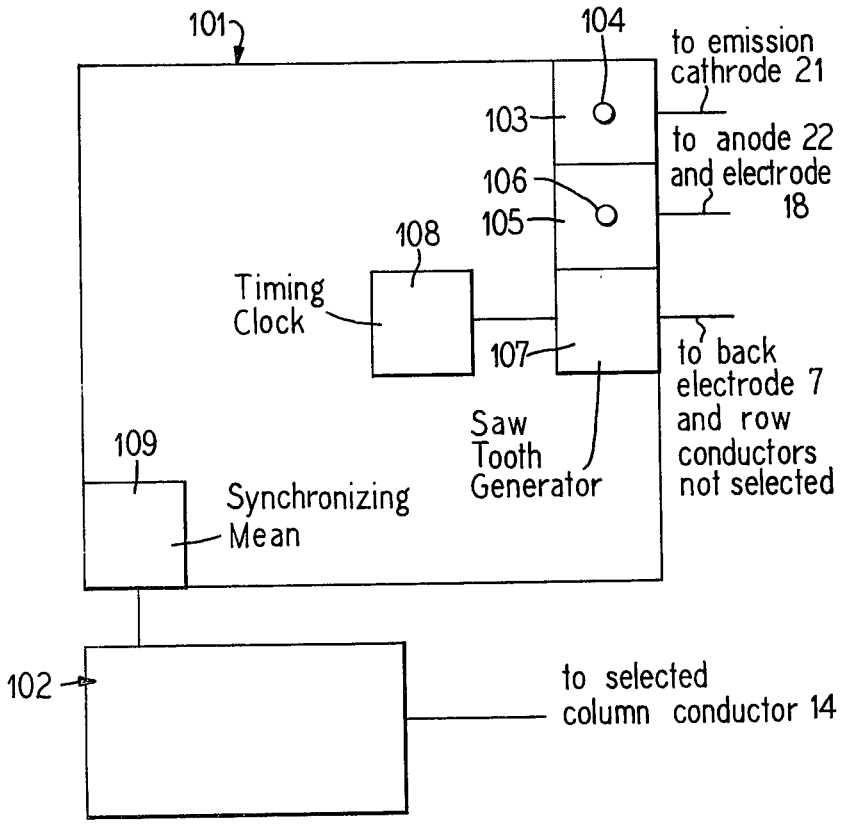
FIG. 6 details units 101 and 102.

As an example, as shown in FIG. 6, a means 101 applies a fixed zero volts reference to emission cathode 21. These can be set in d.c. source 103 by knob 104. D.C. portion 105 of means 101 can be set by knob 106 to apply +100 volts to attraction anode 22 and beam guidance grating electrode 18.

A saw-tooth generator 107 supplies a saw-tooth wave voltage to back electrode 7 and those row conductors 13 which have not been selected.

The means 101 raises the selected or effective row to at least the reference zero.

A timing clock 108 supplies an output to control the saw-tooth generator 107.

Means 102 is interconnected to sychronizing means 109 in means 101 and also supplies a potential to the selected column conductor 14. Unit 102 is conventional and may be as described in U.S. Pat. No. 3,956,667 which is hereby incorporated by reference and which comprises a matrix-address display with row-sequential scanning.

Figure 3A:
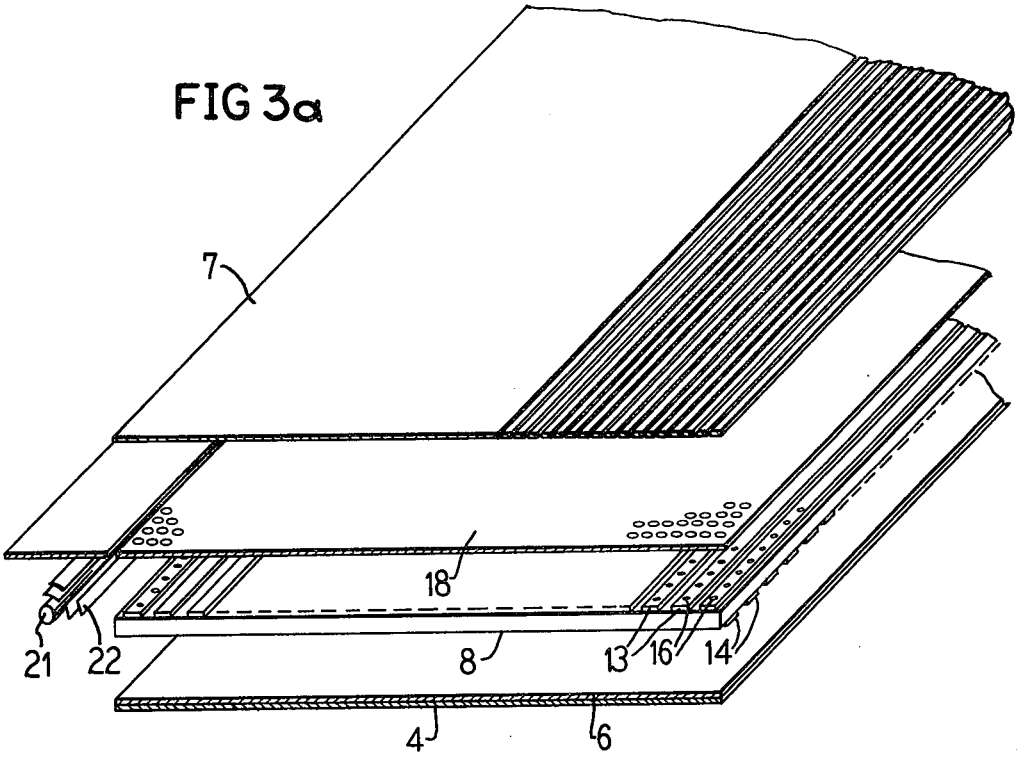
FIG. 3*a* is a perspective view of the tube of the invention.

FIG. 3*a* is a perspective view of the tube.

The potentials for the individual electrodes can be applied in the following manner. If the potential for the emission cathode 21 is selected as a reference potential and is designed as a zero volts reference, the attraction anode 22 and the grating forming the beam guidance electrode 18 are at a postitive potential for example plus 100 volts. The back electrode 7 and the row conductors 13, which have not been selected are at the same negative voltage or potential which is modulated in a saw-tooth shaped-like manner. The voltage of the row conductor which has been selected which is sometimes referred to as the effective row is then raised to at least the reference zero volts of the emission cathode 21 or to low positive value.

By applying these various potentials to the various electrodes, the flat electron beam which has been introduced into the beam guidance space 9 will vibrate periodically between the back electrode 7 and the row conductors 13 to follow a serpentine, sinuous or wave-like path as illustrated by various waves 23 and 24. Each of these beams will cut the plane of the grating forming the beam guidance electrode 18 at least once until it will leave the sinuous shape path at a location of the effective row to strike the effective row in a substantially perpendicular direction to pass through the apertures such as 16 in response to the signal voltage on each column conductor 14 which determines if the electron beam will be blocked or allowed to continue to the layer 4.

The voltage or potentials, which were mentioned hereinabove, are not the only possible ones and therefore the non-selected row conductors 13 which are located between the selected or effected row and electron source 19 may have a negative potential. In addition, the remaining row conductors on the other side of the selected row conductor can also be placed at the same potential so only the effected or selected row is a positive potential with all the other rows being at negative potential.

If the line or row conductors, which have already been scanned, receive a set potential, then the beam vibrations will indeed no longer by symmetrical; however, this is not important in the present context. If the rows which has not been selected, are rigidly biased then one must pay attention that the deflected electron beam will arrive at the selected row with as low energy as possible at an angle which approaches 90°. For under only these conditions can electrons be pulled cleanly by the column lines with a relatively low voltage dispersion.

The beam guidance system is set out so that the beam to the extent possible has the same phase relationship or position at each different deflection location so that comigrating field of deflection in the case of row stepping or advancing deflects the flat beam always in the same manner to the selected row. It is to be recommended, therefore, that the path be dimensioned in such a way that the beam just finishes a vibration which is directed towards the back electrodes 7 at the position for the row which has been selected in such case that it cuts the plane of the grating 18.

In order to fulfill these phase conditions one proceeds in the following manner. If the display has n rows, then these n rows are subdivided into k equally large groups. To illustrate this in FIG. 1, the i-th row or the j-th group is designated 13$_j$. The various potentials, which are applied to the electrodes, are selected in such a way that the flat electron beam travels in a sinuous path which has a wave length so that for each of the first rows of each group, the electron beam has the same position. In the simplest case, the flat electron beam which was introduced obliquely into the back chamber 9 will travel on a serpentine or sinuous path having a wavelength so that the 13$_j$ row has a distance 2j−1 half wave lengths from the source 19 of the electron beam. In order that the phase condition be maintained also in the case of the remaining rows of each group, the wave length of the vibrating beam path is varied in a suitable manner. If one continues in the case of the row scanning for an electron source, then the wave length in each group is to be increased for row 1 to the following row and if a reverse scanning direction is utilized, then the wavelength of the path of the electron beam is correspondingly reduced for the next row. In both cases, a saw-tooth shaped modulation is utilized. For easier understanding three beam paths are illustrated in FIG. 1. For a selected row $13_1^3$ and $13_1^4$ which are both the first row of two groups, it is noted that a serpentine path having a deflection 23 at row $13_1^3$ and also a deflection at 26 at $13_1^4$ have the same wave length. However, at row $13_3^3$, which would be the third row of the third group, the wave length for the path 24 must be increased in order for the beam to strike the row $13_3^3$ at the same angle of approach as it does the other two rows. It should be noted that the distance between the first row of each group is one entire wave length of the sinuous path of the electron beam.

In the case of determining a maximum number of vibrations of the flat electron beam, the following is to be noted. If the number of vibrations grows then on the one hand, the deflection maximum or total amplitude of the path becomes smaller so that the thickness of the beam guidance space or back chamber 9 can be reduced with the result that the total display can be thinner. However, for the ideal case of a parabola-shaped half wave, the result in a simple calculation is mainly the relationship between the distance covered by the electron beam to the number of vibration has a value 2m wherein m equals the number of half waves. On the other hand, with the growing number of vibrations, the portion of the electrons which are lost through striking upon the beam guidance electrode 18 or through focusing errors becomes greater and greater with the results that the efficiency decreases and the contrast gradient which is present along the columns becomes more pronounced. Thus, it is more likely to require compensation measures. Therefore, the electron beam should not receive more than the highest number of half waves absolutely necessary from the point of view of the desired structural depth.

If the ratio of the display size in the direction of the columns 14 to the thickness of the chamber 1 is not so critical, then one can also work with a single half wave. In this case, the potential plane between the back electrode and the row conductor does not need to be realized by means of a special electrode for here a homogeneous cross field and the total beam guidance space will be adequate. However, an arrangement with the wave length for the path selected so that the maximum number of penetration of the grating 18 is in a range 5–10 times and preferably in a range of 6–8 times is desirable.

The invention is not limited to the sample embodiment. For example, in addition to the possibilities or the variations with regard to the voltage relationships, there also exists significant room for variations with regard to the construction. For example, one could provide each of the row conductors with a single longitudinal slit which extends the entire length of the row conductor and will replace the plurality of perforations through the substrate. In addition, the row conductors of the matrix arrangment could be provided as a plurality of control discs interconnected in a manner illustrated in U.S. Pat. No. 3,956,667. While the beam guidance electrode 18 is illustrated as a sheet having a plurality of perforations to form a grid, it could be formed by a plurality of wires with means for holding these wires with the desired spacing parallel to each other and the row conductors. This would be done with the structure disclosed in U.S. Pat. No. 4,103,204.

The device described herein is based on the focusing power of a decelerating field. Suppose the potential of grid 18 (FIG. 1) is set to +100V referring to cathode potential. Set the two neighboring electrodes 7 and 13 to zero, and there will exist an equal contact decelerating field above and below the grid 18. An electron beam entering these spaces under an angle of 45° will follow a parabolic trajectory. The beam under an entrance angle of 45° has equal horizontal and vertical components of an energy of 50 volts each. This is why at the potential surface of +50 V, the vertical energy has been totally spent while the horizontal component stays constant. The trajectory is the same as in ballistics. It is a well known fact that the largest distance is reached at a starting angle of 45°. Small deviations from this optional angle have only a minor influence on the final distance, and this is exactly what is meant by "focusing action".

When the beam reaches its aim (row electrode), it is then focused onto the grid plane again. The beam that penetrates the grid encounters the same conditions of a decelerating field again and, therefore, follows another parabolic trajectory.

Figure 3B:
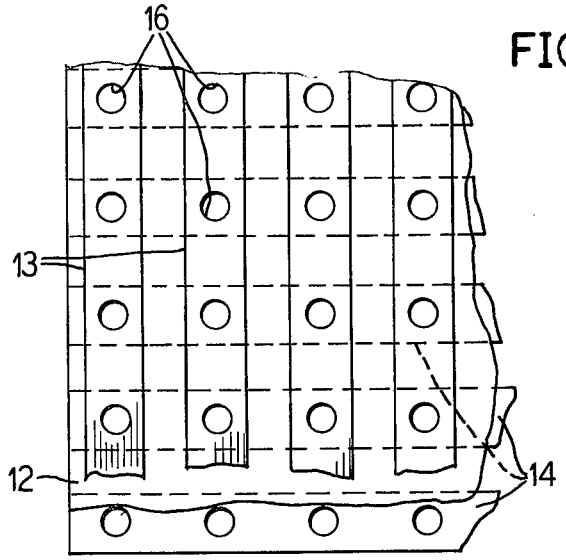
FIG. 3*b* is a plan view of the tube.

In a practical case to be described, choose the spaces between electrodes 18 and 13 and electrodes 18 and 7 to be different. FIG. 3 illustrates the whole focusing device in perspective. The active surface of the display is chosen to be $40\times28$ cm$^2$. The height of the space between electrodes 18-7 is chosen to be 2 cms, the height between 18-13 to be 1 cm. Electrode 7 is a flat sheet of metal which will be branched to the varying deflection potential (from −100V to +33.3V). The grid electrode 18 is an extremely fine mesh with a transparency of at least 90%. Electrode 13 is composed of the horizontal lines (row electrodes). They are metal stripes with a great number of openings as described in the reference patents on the flat gas discharge cathode display. A narrow slot in electrode 13 allows the entrance of the electron beam from cathode 21 which is formed by the cathode grid 3 and the anode 22. The potential of the anode may also be +100V relative to the cathode which means it can be connected to grid 13, but its potential may be much higher, too, in order to draw more current from the cathode.

Figure 4B:
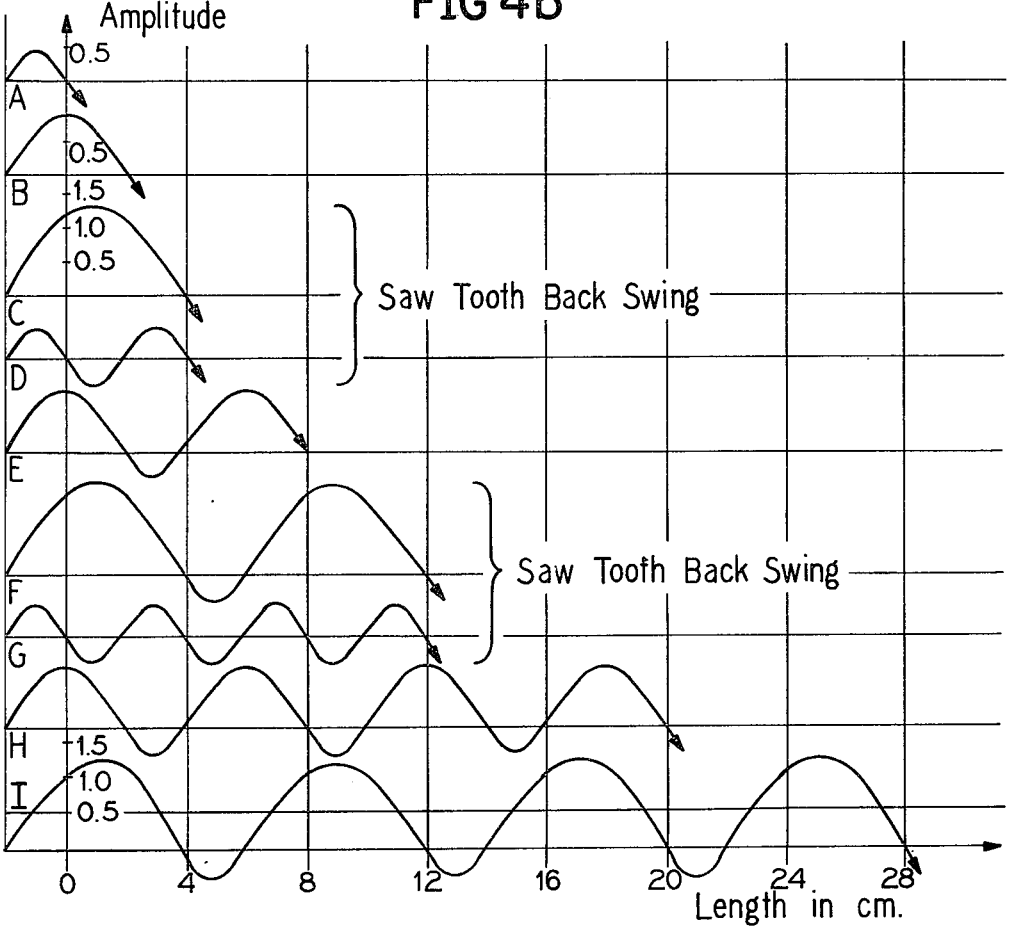
FIGS. 4*a* and 4*b* are plots showing the signals in the invention.

For the deflection of the beam, choose the potential of 13 to be zero volts. To make the two decelerating electric fields equal, put −100V on the electrode 7. Thus, both field strengths are 100 V/cm (100V/1 cm and 200V/2 cm), which allows a beam trajectory similar to a sinusoidal curve (curves A, D and G in FIG. **4*b*). If only the first parabolic is used and the beam is deflected after transmitting electrode 18 (FIGS. 4*b* A), varying the potential of 7 from −100V to 0V makes the field strength in the upper space drop to 50 V/cm. This allows parabola of double the height and distance (B). Increasing the potential at 7 further to +33.1V results in a field strength of 66.7/2 cm=33.3 V/cm. Thus, the trajectory is that of FIG. 4*b*** C, 3 times as high and wide.

The variation of the potential described is shown in FIG. **4*a***. Namely, the voltage as a function of time. At the moment C, the saw tooth curve goes back to its initial value (D). Now the same game starts again (curves E and F). There is an important difference though. While the distance of the beam between A and C is 4 cms, it is now between D and F, 8 cms. This is why the variation of the saw-tooth potential now has to be twice as slow as before. At point F, the potential is swept back again to −100V, and the third saw tooth curve has to be 4 times slower than the first one ($T_3=2T_2=4T_1$). Between F and G, there is another back swing of the saw tooth curve and the same variation of the potential from −100V to +33.3V results in a distance of 16 cm. Thus, the field deflection between A and I is 4+8+16=28 cms. (the height of the display surface in FIG. 3).

Figure 4A:
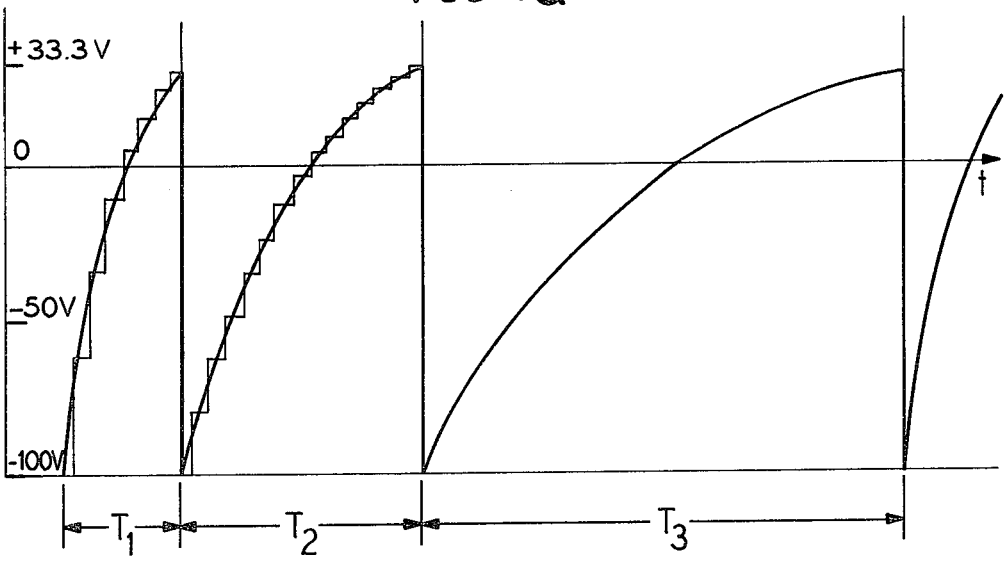

If 560 horizontal lines are used, the width of each line will be 280 mm/560=0.5 mm. As the system used is line sequential, the saw tooth curve should actually not be smooth, but a stepwise curve with each step lasting about 64 μsec). This is indicated in FIG. 4*a*, but of course, only with a tenth of the steps shown (8 instead of 80.) There must be 80 steps in the first section ($T_1$), 160 in the second section ($T_2$), and 320 in the third section ($T_3$), together 560 steps.

Figure 5:
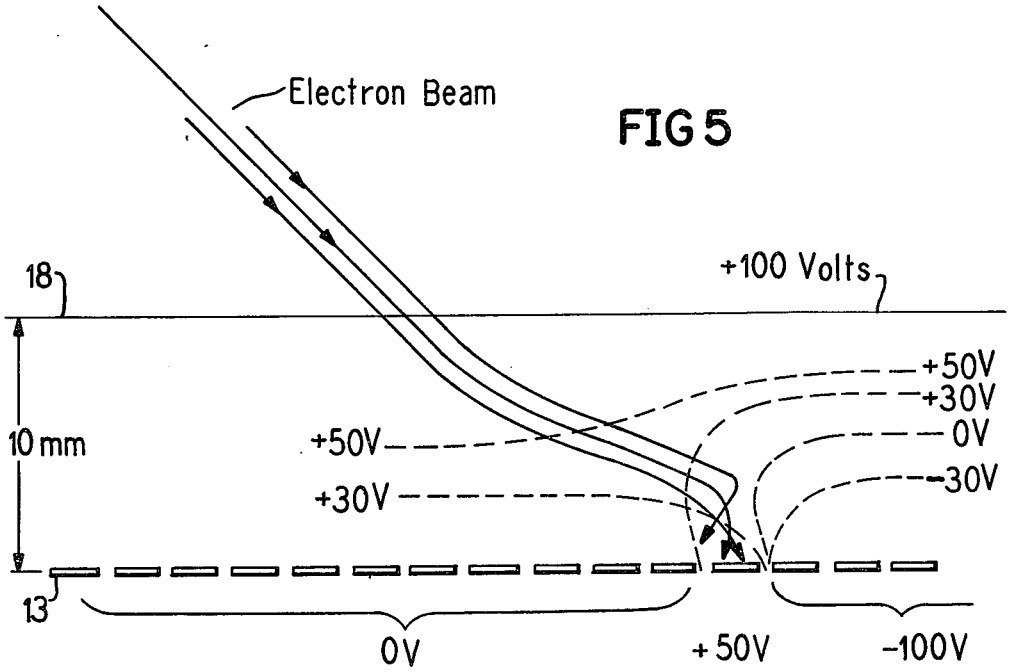
FIG. 5 illustrates various electron beams.

At any moment, the beam enters the space of the line electrode 13 at 45°, it would be bent back to grid 18 if the potential at 13 stayed constant at zero volts and the climax of this trajectory would be in the middle of the space at a potential of +50V. To deflect the beam to the desired line (row), this potential has to be changed. FIG. 5 illustrates the situation. The potential of the line (row) chosen is put to +50V, for example, while all lines before that line (row) stay at zero volts and all lines after it (to the right) are branched to −100V. This results in the potential distribution of FIG. 5. The critical potential plane (or line as drawn) of +50 is bent upward, thus allowing the beam to cross it. The central beam drawn is bent back near the potential line 0. to be attracted by the line (row) electrode at +50 volts. The two accompanying trajectories are influenced in a somewhat different way and indicate the focusing action of this kind of a potential distribution. FIG. 5 shows, too, that a much broader electron beam could not totally be focused to the desired line which indicates that a certain quality of the final electron beam is still to be desired.

Nevertheless, this kind of a focusing system is much superior to the focusing systems that have been used in former developments of flat picture tubes (Kaiser tubes, Gabor tubes). The electron beam herein is not to be focused to a single picture element but only into the neighborhood of the chosen line. This tolerance in distance may well allow the use of a smooth saw tooth curve instead of a stepped one. Then the electrons are attracted by the line (row) potential and those which are not used are deflected and reflected away without causing any trouble. The electrons that cross the openings in the line electrode can all be used for the building up of the image being formed upon the screen after their intensity has been controlled.

Of course, there is a loss of intensity of the beam through the manifold crossings of the grid electrode 13. Thus, from A to C the beam crosses the grid only once, after D it crosses it 3 times and after C, 7 times. Admitting a loss of 90% of this grid 18, the intensities vary like 1 to $0.9^2=0.87$ to $0.9^6=0.53$. The variation of the cathode grid potential may easily correct the current by increasing the primary current correspondingly. But even the loss through poor focusing at the last lines may be corrected by the same procedure.

Although various minor modifications may be suggested by those versed in the art, it should be understood that I wish to embody within the scope of the patent granted hereon, all such modifications as reasonably and properly come within the scope of my contribution to the art.

I claim as my invention:

1. A method for displaying optical information in a flat cathode ray tube comprising the steps of providing a flat cathode ray tube leaving an evacuated container having a front and back wall which are parallel to each other, said front wall supporting a cathodo-luminescent layer and a flatly extending acceleration anode, said back wall having a flatly extending back electrode, said container in a plane extending parallel to the front and back walls and sub-dividing the chamber into a back chamber and a front chamber being provided with a substrate having a plurality of parallel extending conductive strips forming at least one group of row conductors facing the back electrode and on a surface opposite the row conductors being provided with a plurality of parallel conductor strips extending perpendicular to the direction of the row conductors to form column conductors, said substrate being provided with apertures disposed in the row conductors, said cathode ray tube being provided with an electron source extending along one side wall of the container parallel to the row conductors, said electron source including one emission cathode as well as one attraction anode to produce a flat electron beam having a width which extends the entire length of the row conductors, extends parallel to the row conductors, and projects the beam obliquely into the back chamber, said tube including a beam guidance electrode with an equal potential extending in a plane parallel to the back wall between the row conductor and the back electrode; controlling the potentials applied on the back electrodes, the acceleration anode, the emission cathode, the attraction anode, the beam guidance electrode and the row conductors to project a flat beam from the electron source obliquely into the back chamber to travel in a sinuous path with a wavelength and with penetration of the plane of the beam guidance electrode at least once prior to penetrating a selected row conductor and to penetrate successively selected row conductors, said controlling including applying a base potential to the cathode, applying a potential more positive than the base potential to the beam guidance electrode, applying potentials more negative than the base potential to the back electrode and to at least all of the row conductors located between a selected row conductor and the cathode, and raising the potential on each selected row coneuctor to be ≧ to the base potential to move the selected row conductors along the row conductive successively; changing the wavelength of the sinuous path of the flat beam in a saw tooth manner so that the flat beam strikes each row conductor of the group of conductors after travelling the same number of half wavelengths and after leaving the sinuous path at the same phase of the path, said changing of the wavelength includes modulating the potential applied to at least one of the back electrodes, beam guidance electrode, non-selected row conductors and the attraction anode in a saw tooth manner; and providing selected signal voltages to the column conductors to selectively block the passage of the electron beam through space points of the selected row conductor and enable passage at other points so that the electron beam strikes selected points of a row of points on the cathodo-luminescent layer associated with the selected row conductor.

2. A method according to claim 1, wherein the position of the electron source and the controlling of the emission cathode and the attraction anode causes the flat electron beam to be released from the source on a path extending 45° to the plane of the back electrode.

3. A method according to claim 1, which includes increasing the intensity of the flat electron beam as it is released from the electron source as the distance of the selected row conductor from the source is increased so that the intensity of the beam passing through the selected row conductor and striking the cathode luminescent layer are substantially the same.

4. A method according to claim 1, wherein the step of modulating the potential modulates the potential applied to the attraction anode.

5. A method according to claim 4, wherein the beam guidance electrode and the attraction anode are electrically connected to having the same potential.

6. A method according to claim 1, wherein the step of modulating the potential modulates the potential applied to the back electrode.

7. A method according to claim 1, wherein the step of controlling the applied potential applies the same negative potential to the back electrode and the row conductors that are not selected.

8. A method according to claim 7, wherein the step of applying a base potential to the selected row applies a potential somewhat positive to the value of the potential applied to the emission cathode.

9. A method according to claim 1, wherein the step of controlling the potentials includes applying a set negative potential to only the row conductors which are located between the selected row conductor and the electron source.

10. A method according to claim 1, wherein the step of controlling the potentials includes applying a set negative potential to the non-selected rows extending between the selected row conductor and the electron source and to the remaining non-selected row conductors.

11. A method according to claim 1, wherein the step of changing the applied potentials causes the flat electron beam to pass through the plane of the beam guidance electrode between five and ten times.

12. A method according to claim 1, wherein the step of providing selected signal voltages applies television picture signals so that said tube displays a television picture.

13. A flat cathode ray tube comprising an evacuated container having a front and back wall extending parallel to each other, said front wall supporting a cathodoluminescent layer and a flatly extending acceleration anode, said back wall having a flatly extending back electrode, said container in a plane extending parallel to the front and back wall and dividing the chamber into a back chamber and a front chamber being provided with a substrate having a plurality of parallel extending conductive strips forming at least one group of row conductors facing the back electrode and on a surface opposite the row conductors being provided with a plurality of parallel conductive strips extending perpendicular to the direction of the row conductors to form column conductors, said substrate being provided with apertures disposed in the row conductors; an electron source extending along one side wall parallel to the row conductors, said electron souce including one emission cathode as well as one attraction anode to produce a flat beam having a width which extends the entire length of the row conductors, extends parallel to the row conductors and to project said beam obliquely into the back chamber; a beam guidance electrode of equal potential extending in a plane parallel to the back wall between the row conductors and the back electrode; means for controlling the potentials applied on the back electrode, the front acceleration anode, the emission cathode, the attraction anode, the beam guidance electrode, the selected and the non-selected row conductors so that the flat beam leaving the electron source travels in a sinuous path with a wavelength penetrating the plane of the beam guidance electrode at least once prior to penetrating each selected row conductor and directing the beam to penetrate the row conductors successively, said means for controlling applying a base potential to the emission cathode, applying potentials more negative than the base potential to the back electrode and at least all of the row conductors located between the selected row conductor and the cathode, applying a potential more positive than the base potential to the beam guidance electrode, and raising the potential of the selection row conductor to $\geqq$ the base potential to move each selected row conductor along the row conductors successively; said means for controlling changing the wavelength of the sinuous path of the flat electron beam in a saw tooth manner so that the flat beam strikes each row conductor of the group of row conductors after travelling the same number of half wave lengths and after leaving the sinuous path at the same phase of the path by modulating the potential applied to at least one of the back electrode, beam guidance electrode, non-selected row conductors and the attraction anode in a saw tooth manner; and means providing selected signal voltages to the column conductors to selectively block the passage of the electron beam through the spaced points of the selected row conductor and enable passage at other points so that the electrode beam strikes selected points of a row of points on the cathodo-luminescent layer associated with the selected row conductor.

14. A cathode ray tube according to claim 13, wherein the beam guidance electrode comprises a sheet provided with a plurality of perforations to produce a grid.

15. A cathode ray tube according to claim 13, wherein the beam guidance electrode comprises a plurality of wires and means mounting said wires to extend parallel to the row conductor.

16. A cathode ray tube according to claim 13, wherein the apertures in the substrate comprise a plurality of equal distance spaced electron beam passage apertures disposed along each row conductor.

17. A cathode ray tube according to claim 13, wherein the apertures in the substrate for the row conductors comprise a single electron beam passage aperture in the form of a slit for each row conductor, said slit extending the entire length of the conductor.

18. A cathode ray tube according to claim 13, wherein the back electrode comprises a plurality of parallel extending strips, said strips extending parallel to the row conductors.

19. A cathode ray tube according to claim 13, wherein the electron source is positioned so that the flat beam produced thereby extends at an angle 45° to the back electrode.

20. A cathode ray tube according to claim 13, wherein the beam guidance electron and attraction anode are electrically interconnected.

* * * * *